United States Patent [19]

Brown

[11] Patent Number: 4,549,680

[45] Date of Patent: Oct. 29, 1985

[54] PRECISE INTERMITTENT FEEDING APPARATUS FOR EDGEWISE PERFORATED CARRIER SHEET MATERIAL

[75] Inventor: Richard L. Brown, Bellevue, Nebr.

[73] Assignee: Idea Engineering Company, Plattsmouth, Nebr.

[21] Appl. No.: 677,247

[22] Filed: Dec. 3, 1984

[51] Int. Cl.[4] ..... B65H 17/36; B65H 17/44

[52] U.S. Cl. ..... 226/76; 226/139; 226/146

[58] Field of Search ..... 226/76, 138, 139, 145, 226/146, 147, 148, 149, 150, 156, 157

[56] References Cited

U.S. PATENT DOCUMENTS 3,281,037 10/1966 Young ..... 226/76 X

*Primary Examiner*—Stuart S. Levy
*Assistant Examiner*—Lloyd D. Doigan
*Attorney, Agent, or Firm*—George R. Nimmer

[57] ABSTRACT

Disclosed is economical and reliable apparatus for precisely intermittently feeding prescribed finite-lengths of edgewise perforated carrier sheet material. The intermittent feeding apparatus basically requires a rotatable drum having its cylindrical surface provided with circularly arrayed radially extending prongs that are removably engageable through the carrier edgewise perforations and which drum is intermittently rotated for a prescribed angular-value cycle so that the drum prongs feed the carrier for an approximate-length roughly equivalent to the desired exact finite-length. At the conclusion of each incremental rotation for the pronged drum, a camming assembly (having a camming first-component circularly arrayed around the drum and having a camming second-component mounted to a reciprocatable piston) rectifies the approximate-length carrier feed into the exact finite-length feed desired for the carrier sheet material.

17 Claims, 7 Drawing Figures

FIG. 6
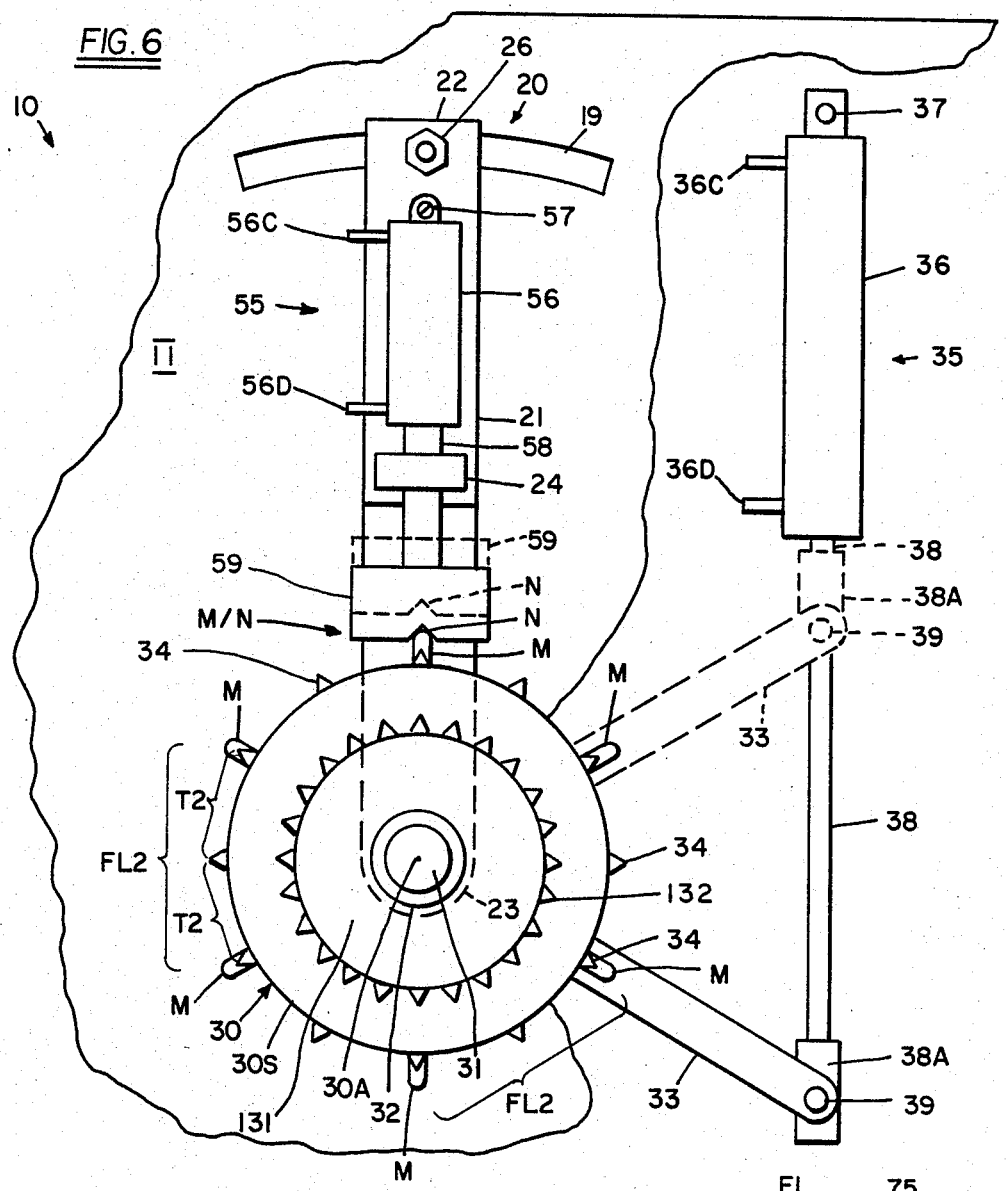
FIG. 1
(PRIOR ART)
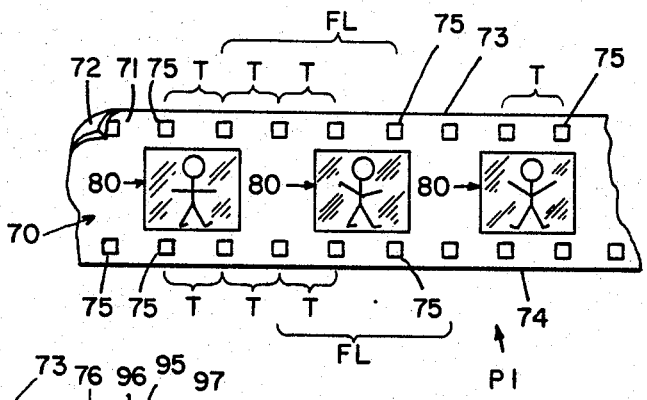
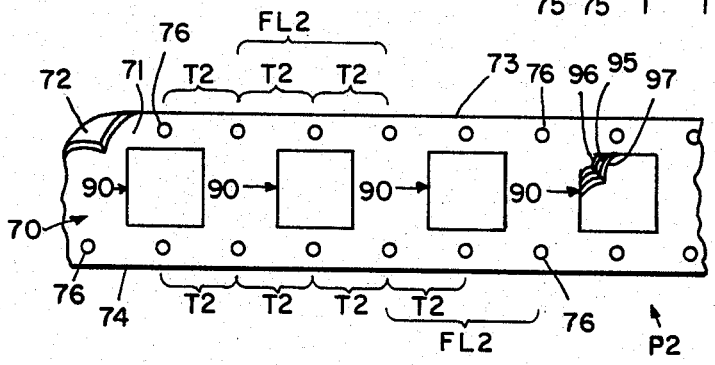
FIG. 2
(PRIOR ART)

PRECISE INTERMITTENT FEEDING APPARATUS FOR EDGEWISE PERFORATED CARRIER SHEET MATERIAL

BACKGROUND OF THE INVENTION

Drawing FIGS. 1 and 2 represent top plan views of two types of indefinitely longitudinally lengthy and edgewise perforated carrier sheet materials of the prior art. The edgewise perforations along one or both of the transversely separated longitudinal edges are spaced at regular-intervals (e.g. T, T2) and each perforations being of substantially identical shape and having a prescribed finite-area. Along its longitudinal length, the flexible carrier sheet material is provided with carried-members (e.g. 80, 90) incrementally regularly spaced at finite-lengths (e.g. FL, FL2) and wherein the finite-length represents a fixed ratio to the perforations regular-intervals.

Carrier sheet material embodiment P1 of FIG. 1 is of the cinematic film strip type and comprises flexible web 70 and photographic carried-members 80. Longitudinally extending web 70 has a broad upper-surface 71, a broad lower-surface 72, and a longitudinal first-edge 73 transversely separated from a longitudinal second-edge 74. Adjacently parallel along edges 73 and 74, web 70 is provided with rectangular perforations 75 spaced at regular-intervals T and each having the same finite-area. Photographic carried-members 80 are separated at finite-lengths FL along web portion 70, the ratio of FL to T being three.

Carrier sheet material embodiment P2 of FIG. 2 takes the form of a labels supporting web suitable for an industrial application of transferring labels to a suitable receptor (e.g. P3). Though carrier embodiment P2 also includes longitudinally extending flexible web 70, the constant finite-area perforations 76 are of circular shape and are at prescribed regular-intervals T2. The carried-members 90 comprise rectangular labels 95 having adhesive coatings 96 (at web upper-surface 71) at 97. Carried-members 90 are at finite-lengths FL2 along web 70, the ratio of FL2 to T2 being two.

With such prior art carrier sheet material (e.g. P1, P2, etc.), apparatus is employed for longitudinally intermittently feeding same at said finite-lengths (e.g. FL, FL2, etc.) for sequential utilization of the carried-members (e.g. 80, 90, etc.). As is well known in the prior art, such intermittent feeding apparatus utilizes a rotatable drum having its cylindrical surface (e.g. 30S) provided with radially extending prongs (34) removably engageable through the carrier edgewise perforations (e.g. 75, 76, etc.). In the latter vein, the drum prongs (34) are distributed in a uniplanar circular array at regular-intervals (e.g. T, T2, etc.), the cross-sectional shape and size for the respective prongs being similar to that for the carrier edgewise perforations. The drum finite-circumference represents a ratio bearing an exact multiple of the prongs regular-intervals spacing about the drum circumference.

Drawings FIGS. 3 and 4 are top plan and frontal elevational views, respectively, of a rudimentary prior art apparatus 100 for intermittently longitudinally feeding carrier sheet material at finite-length steps (e.g. embodiment P2 at finite-length steps FL2). Apparatus 100 comprises a rotatable drum 130 having a cylindrical surface 30S and a central shaft 31 both concentrically surrounding transversely extending horizontal drum-axis 30A. Transversely extending shaft 31 intersects and is revolvably secured to upright frame member 11. Connected to drum shaft 31 is a drive-sprocket 135 having radially extending teeth 136 whereby conventional motive power (not shown) intermittently supplied to sprocket chain 137 causes pronged drum 30 to intermittently rotate at prescribed angular-value cycles about drum-axis 30A. Provided the angular-value cycle for drum 130 is accurately controlled, the drum prongs 34 (which are removably engageable through one or more of the carrier edgewise perforations) will cause the carrier (P2) to move intermittently longitudinally for the desired finite-length (FL2) whereupon the carried-members (90) are sequentially utilizeable. In the latter vein, the finite-length spaced labels 95 might be transferred from carrier P2 to a receptor sheet P3 co-intermittently fed about rotatable receptor drum 50 (as indicated in triple-headed arrows), whereupon the intermittent feeding rates for sheets P2 and P3 are uniform.

As best seen in FIG. 4, receptor drum 50 has a cylindrical surface 50S and a central shaft 51 both concentrically surrounding transversely extending horizontal drum-axis 50A. Transversely extending drum shaft 51 intersects and is revolvably secured to upright frame member 11. The finite-circumferences for cylindrical surfaces 30S and 50S are equal, and thus, if drums 30 and 50 are made to intermittently rotate in concert (as indicated by double-headed curved arrows), equal feeding rates for carrier P2 and receptor P3 should result. In the latter regard, drum shafts 31 and 51 are provided with equal diameters transmission-sprockets 131 and 151, respectively. Figure-8 chain 133, which engages teeth 132 and 152 of the transmission-sprockets, causes drums 30 and 50 to co-intermittently rotate in concert whereby the desired condition of equal intermittent feeding rates for carrier P2 and receptor P3 might result. Thus, as carrier P2 comes "IN" toward idler roller 146, and thereafter turns abruptly at angular fitting 12 (attached at 13 to frame 11), the lable type carried-members 90 are transferrable sequentially to receptor P3. From angular fitting 12, carrier P2 (devoid of carried-members 90) proceeds toward its intermittent drive (e.g. pronged drum 130), and thence to idler roller 147, and ultimately "OUT" apparatus 100.

Though in theory rudimentary apparatus 100 of FIGS. 3 and 4 should cause intermittent longitudinal feeding of the carrier (e.g. P2, P1, etc.) for the precise finite-length (e.g. FL2, FL, etc.), such precise intermittent feeding is exceedingly difficult to attain as a practical matter. Accordingly, the prior art has had to resort to high-tolerance mechanism such as of the star-and-cam type, the Geneva-gear type, etc., all of which are not only exceedingly expensive to produce but which also mechanically wear below the high-tolerance requirements' thereof. Thus, the expensive high-tolerance apparatus soon becomes unreliable for its intended precise feeding purposes.

OBJECT OF THE INVENTION

It is accordingly the general object of the present invention to provide precise intermittent feeding apparatus for edgewise perforated carrier sheet material that represents marked improvement over the prior art in that the apparatus is comparatively inexpensive to produce and is unusually resistant to mechanical wear during extended usage, and hence operates economically and reliably over long term usage thereof. It is an ancillary objective to provide precise intermittent feeding apparatus for edgewise perforated carrier sheets wherein the apparatus might be adapted for various utilitarian purposes including, inter alia, for useage with a co-intermittently moving elongate receptor sheet adapted to adherently receive releasable carried-members (e.g. labels) of the carrier sheet material.

GENERAL STATEMENT OF THE INVENTION

With the above and other objects and advantages in view, which will become more apparent as this description proceeds, the precise intermittent feeding apparatus (for edgewise perforate carrier sheets) of the present invention comprises: a drum having a cylindrical surface rotatable about a transversely extending drum-axis and said cylindrical surface being provided with equidistantly spaced radial prongs adapted to extend removably through the carrier edgewise perforations and thereby longitudinally feed the carrier as the drum rotates; driving means for intermittently rotating the drum for a nominal angular-value cycle to provide an approximate-length of the desired finite-length intermittent feed for the carrier; camming means of the conventional two components pin-and-block type, a first component thereof being distributed about the drum circumference, and a camming second-componemt comprising a linearly reciprocatable block adapted to co-act with a camming first-component of the periodically stopped drum; and said camming co-action rectifying the drum fed approximate-length into the precise finite-length intermittent feed desired for the carrier sheet material.

BRIEF DESCRIPTION OF THE DRAWING

In the drawing, wherein like characters refer to like parts in the several views, and in which:

FIG. 1 is the aforedescribed top plan view of one type of prior art carrier sheet material utilizeable with the precise intermittent feeding apparatus of the present invention;

FIG. 2 is the aforedescribed top plan view of another type of prior art carrier sheet material utilizeable with the precise intermittent feeding apparatus of the present invention;

FIG. 6 is a frontal elevational view of representative embodiment 10 taken along line 6—6 of FIG. 5.

GENERALIZED DESCRIPTION OF THE DRAWING

Figures 5, 7:
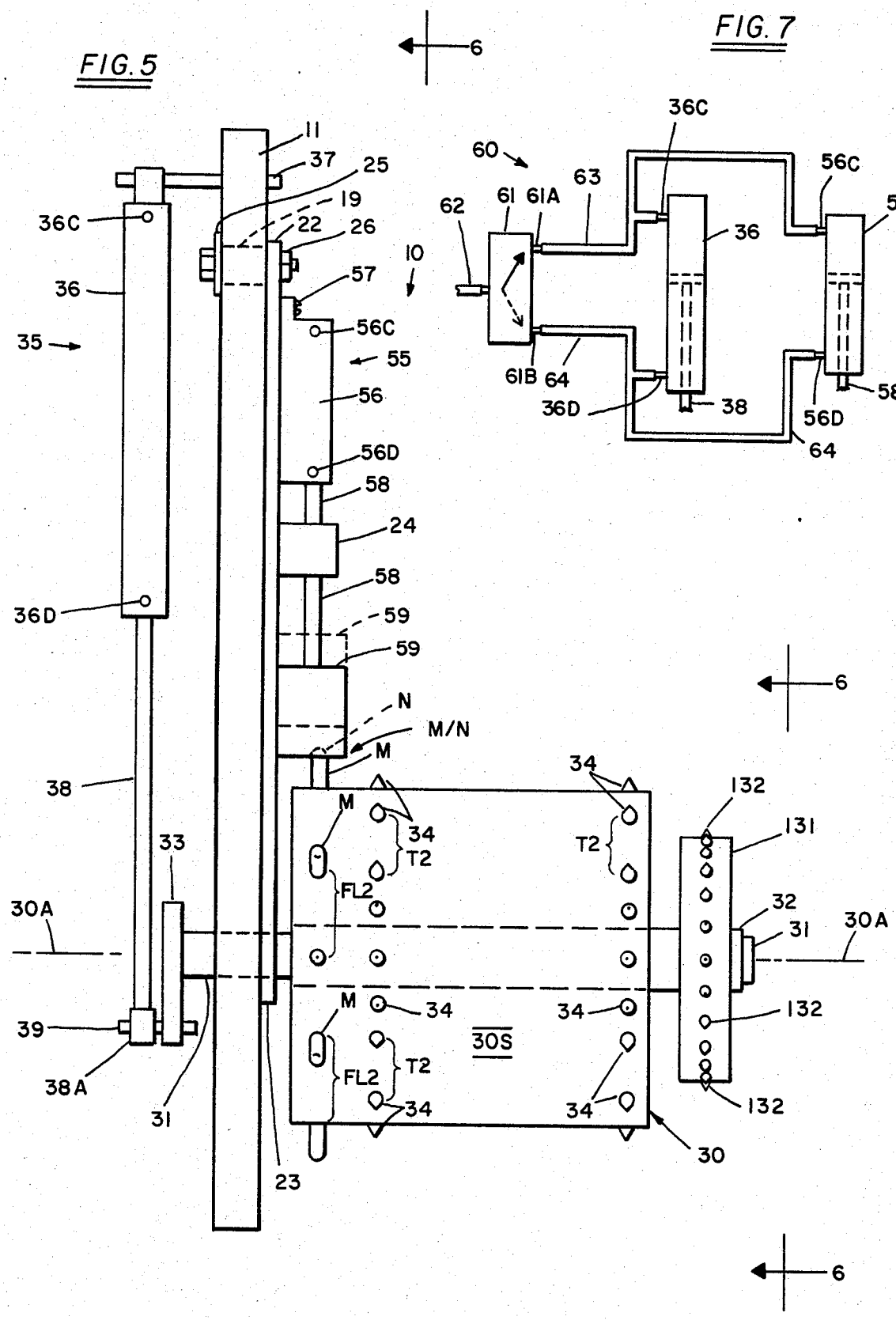
FIG. 5 is a side elevational view of a representative embodiment 10 of the precise intermittent feeding apparatus of the present invention and employable with prior art edgewise perforated carriers and engineered especially for the carrier of FIG. 2.
FIG. 7 is a schematic drawing of synchronized motive control means mechanism for representative apparatus embodiment 10.

As typified by drawing FIGS. 5–7, the precise intermittent feeding apparatus (for edgewise perforated carriers e.g. P1, P2, etc.) of the present invention comprises in the general sense:

(a) as shown in the prior art, a drum (30) provided with at least one uniplanar circular array of drum prongs (34) spaced at regular-intervals (e.g. T, T2, etc.) about the finite-circumference (30S) whereby said prongs are removably engageable through like regular-intervals perforations (e.g. 75, 76, etc.) and longitudinally feed the carrier as the drum is made to rotate about its central drum-axis (30A);

(b) camming means of the conventional two components pin-and-block type, a camming first-component (e.g. pins "M") being distributed in a circular array at regular-spacings (e.g. "FL", "FL2", etc.) about the drum finite-circumference;

(c) intermittent driving means for intermittently rotating said drums (having prongs and camming first-component) at prescribed angular-value cycles whereby each driving cycle (through said drum prongs) feeds the carrier longitudinally for an approximate-length that is roughly equivalent to the desired exact finite-length (e.g. "FL", "FL2", etc.), said driving means being typified by drum shaft (31) crank (33) pivotably connected (39) to a driving-piston (38); and (d) plunger means (55) including linearly reciprocatable camming means second-component (e.g. V-indented ("N") block (59)) and said camming second-component being adapted to co-act with the camming first-component (e.g. "M") of the intermittently stopped drum and rectify the previously attained approximate-length carrier feed into the precise finite-length (e.g. "FL", "FL2", etc.) intermittent feed desired for the carrier.

DETAILED DESCRIPTION OF THE DRAWING

Turning now to drawing FIGS. 5–7 which explain representative embodiment 10 of the precise intermittent feeding apparatus of the present invention.

Character 11 generally indicates apparatus framework which includes supporting means (20) for supporting plunger means (55) having the linearly reciprocatable camming means second-component (e.g. "N"). Framework 11 further includes means (e.g. at 31) for rotatably supporting drum 30, and means (e.g. at 37) for supporting the drum intermittent driving means (e.g. 35).

Figure 4:
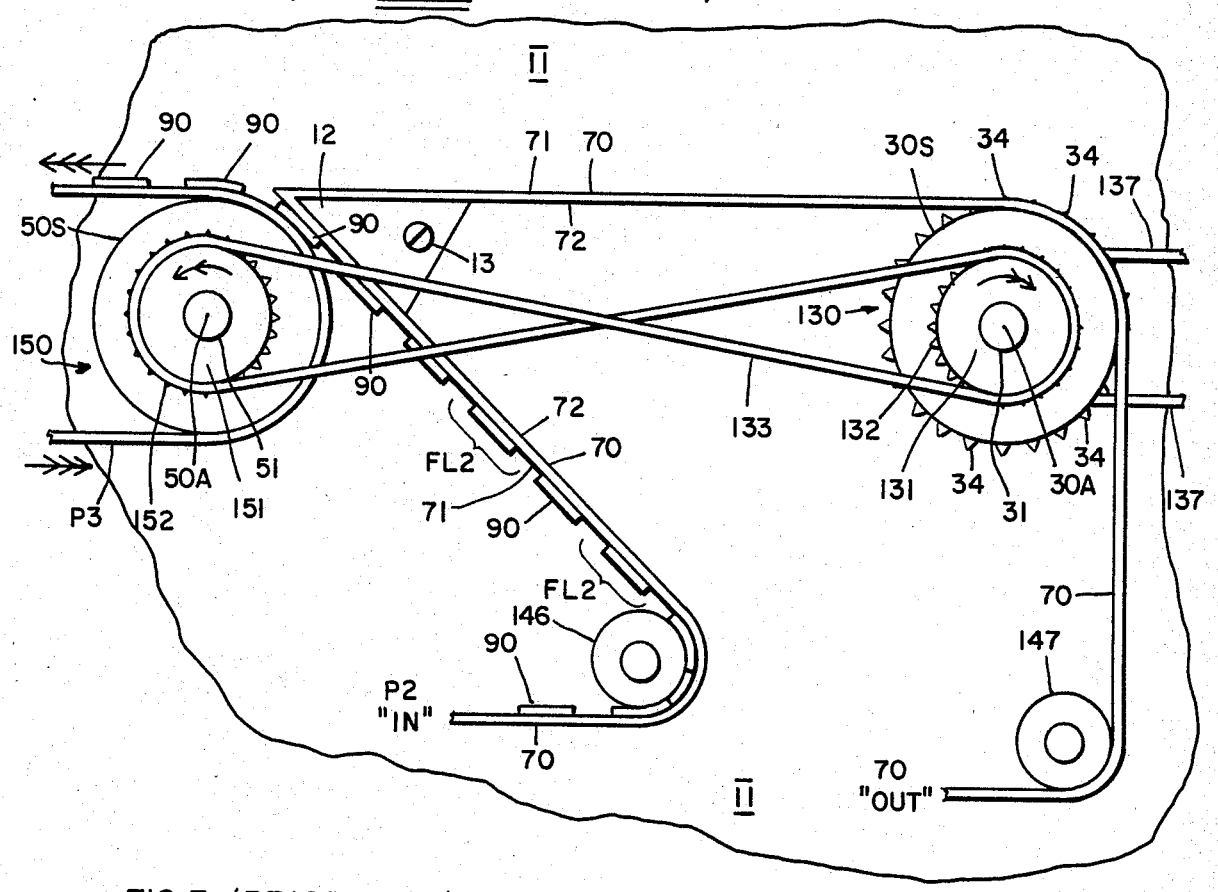
FIG. 4 (PRIOR ART)
FIG. 4 is a frontal elevational view of the rudimentary apparatus 100 taken along line 4—4 of FIG. 3.
Figure 3:
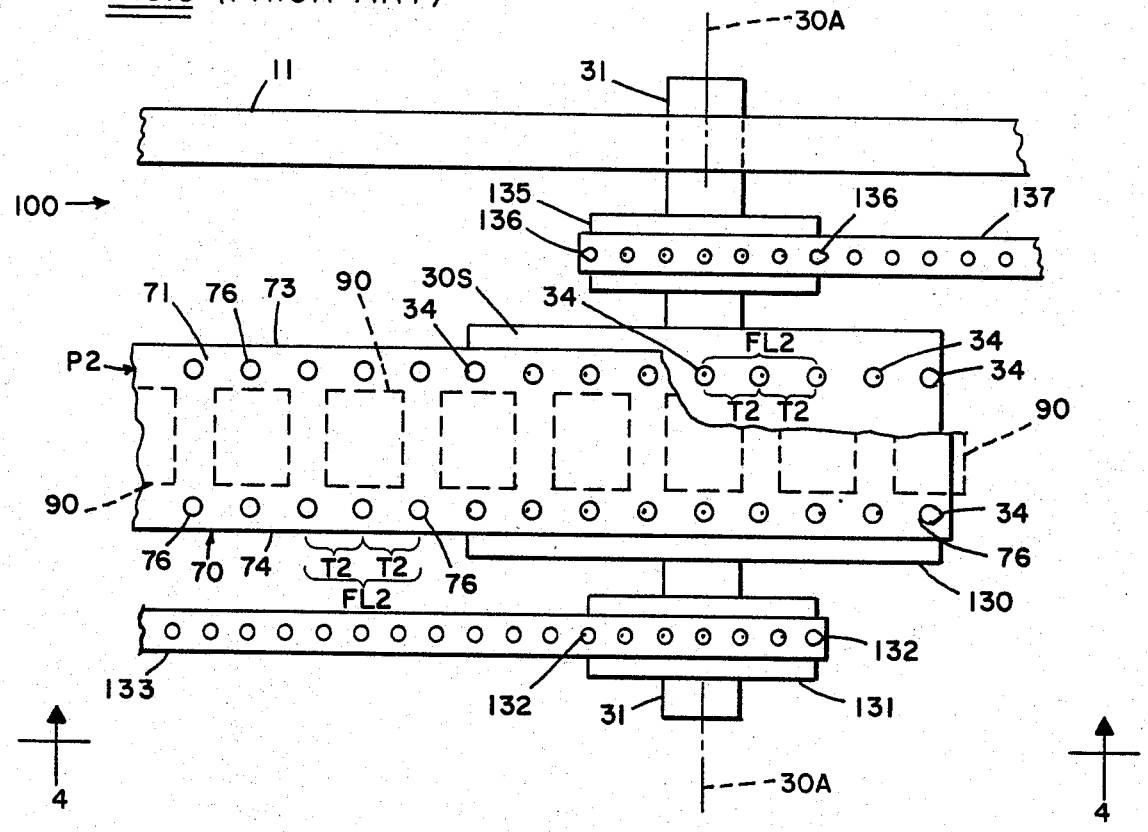
FIG. 3 (PRIOR ART)
FIG. 3 is a top plan view of the aforedescribed rudimentary prior art apparatus 100 for feeding prior art carrier sheet materials.

As previously mentioned, the cylindrically surfaced (30S) and pronged (34) drum is substantially taught in the prior art. For drum 30, its transversely extending central shaft 31 and its finite-circumference 30S both circularly concentrically surround transversely extending drum-axis 30A. Prongs 34, which respectively extend radially outwardly from drum surface 30S, herein occur in two transversely separated uniplanar circular arrays, respective prongs in each array being in transversely aligned pairs. Respective prongs 34 are of substantially identical cross-sectional shape and of finite-area corresponding to the edgewise perforations of the carrier to be longitudinally fed thereby. Herein, for utilization with circular perforations 76 of carrier P2, the prongs 34 are appropriately of circular cross-sectional shape, and with the prongs being at regular-intervals T2 about the drum finite-circumference. In the latter vein, the drum finite-circumference as compared to the prongs regular-intervals represents an integral number ratio preferably of at least four. As seen in FIG. 6, the ratio employed is twelve i.e. each regular-interval T2 representing 30° of the 360° finite-circumference. Exteriorally of tubular drum shaft 31 is a conventional sprag clutch 32, which appropriately permits drum rotatability in the FIG. 6 clockwise direction around drum shaft 31. Drum shaft 31, remote of its rotatable connection to framework 11, might be provided with the sprocket 131, such as for the purposes heretofore described in connection with FIGS. 3 and 4.

As previously alluded to, there are intermittent driving means for intermittently rotating pronged drum 30 at prescribed angular-value cycles whereby each driving cycle longitudinally feeds the prongs engageable carrier (e.g. P1, P2, etc.) for an approximate-length roughly equivalent to the desired precise finite-length feed (e.g. "FL", "FL2", etc.). For apparatus embodiment 10, the intermittent drum rotation is effected by the combination of a radial crank 33 of the drum shaft 31 pivotably connected (at 39) to linearly reciprocatable driving-piston 38 of drive-plunger 35. Drive-plunger 35 comprises a tubular casing 36 equipped with fitting ports 36C and 36D located on opposite sides of driving-piston 38 which is conventionally slidably disposed within casing 36 as indicated in FIG. 7 phantom line. Herein, the leadward end of driving-piston 38 is provided with an enlarged fitting 38A and through which passes the pivotal connection 39 to crank 33. The utilization of solid lines and phantom lines for crank 33, driving-piston 38-38A, and for their pivotal connection 39, respectively indicate the beginning and and the end of each angular-value rotational cycle for pronged drum 30 about its drum-axis 30A. In this regard, empirical selections for the crank radial extent from drum-axis 30A to pivotal connection 39, and of the driving-piston (38) lineal stroke length, assure that the appropriate number of prongs (from a single circular array) counterclockwisely arcuately pass by the apparatus indexing-station ("MN"). These appropriate empirical selections result in a carrier longitudinal feed of an approximate-length roughly equivalent to the desired exact finite-length (e.g. three prongs 34 for finite-length "FL", two prongs 34 for finite-length "FL2", etc.

The immediately aforementioned apparatus indexing-station ("MN") is an exceedingly important aspect of the present invention, for it is there that drum camming is effected at the end of each intermittent angular-value cycle and whereby said camming rectifies the approximate-length carrier feed into the exact finite-length feed desired (e.g. "FL", "FL2", etc.).

For said drum camming at the end of each prescribed angular-value drum rotation, conventional camming means of the two components pin-and-block type are employed. A camming means first-component is distributed in a uniplanar circular array spaced at regular-spacings on said drum at a substantially uniform finite-radius from drum-axis 30A. A camming means second-component is provided at the leadward end of a linearly reciprocatable piston (58); the leadmost position of said piston (indicated in solid line) is in camming relationship to the drum carried camming first-component and thereat defines the apparatus indexing-station("MN"). For apparatus 10, the camming first-component takes the form of a hemispherically headed pin "M", and the camming second-component takes the form of a block 59 including a cross-sectionally V-shaped indentation "N" adapted to co-actably slidably cam against a first-component "M" of the intermittently stopped rotatable drum 30.

Regarding the camming first-component pin "M", such uniplanar circularly arrayed pins "M" at their hemispherical heads lie along a finite-radius locus from drum-axis 30A and whereby with reference to cylindrical surface 30S they extend radially further therefrom than do prongs 34. As best seen in FIG. 5, respective camming pins "M" might be transversely aligned with transversely aligned prongs 34, and the pins' regular-spacing is equivalent to the desired finite-length feed (e.g. "FL", "FL2", etc.). Thus, as best seen in FIG. 6, the depicted regular-spacing represents 60° of the 360° drum finite-circumference.

Regarding the camming second-component as the V-indented("N") leadward block 59 for the linearly reciprocatable piston 58 of plunger 55. Plunger 55 comprises a tubular casing 56 equipped with fitting ports 56C and 56D located on opposite sides of piston 58 which is conventionally slidably disposed within casing 56, as indicated in FIG. 7 phantom line. As previously alluded to, framework supporting means 20 includes a fastening device 57 for plunger casing portion 56. Empirical selection for the lineal stroke length of leadwardly equipped(59, "N") piston 58 is such that the camming second-component thereon("N") is available to co-actably cooperate with camming first-component("M") of the intermittently stopped rotatable drum 30. Accordingly, said empirical selection also establishes the apparatus indexing-station ("MN").

Drawing FIG. 7 schematically indicates control means 60 for sequentially controlling the operation of apparatus 10 such that the reciprocating camming piston 58 moves into the apparatus indexing-station ("MN") at the conclusion of each angular-value cycle for pronged drum 30. Character 61 denotes a conventional programmable solenoid valve having control positions 61A and 61B for an incoming compressed air supply 62. Connector hose 63 proceeds from valve port 61A to casing ports 36C and 56C, and connector hose 64 proceeds from valve port 61B to casing ports 36D and 56D. When apparatus 10 is at intermittent "at rest" condition, 61A is "on" and valve position 61B is "off" whereby compressed air flows exclusively through hose 63 and ports 36C and 56C, and the FIGS. 5-6 solid lines conditions for crank 33 and leadward block 59 are established. Then, when the valve program effects valve position 61A "off" and valve position 61B "on", compressed air then flows exclusively through hose 64, and the FIGS. 5-6 phantom lines condition for crank 33 and said leadward ward block (59"N") are established.

Having now described the basic construction for apparatus 10, its operation for precisely intermittently feeding edgewise perforated carrier sheet material at exact finite-lengths might be summarized as follows. Assuming that the carrier selected is embodiment P2 having regular-intervals (T2) edgewise perforations (76) and carried-members (90) at finite-length frequency "FL2", such carrier P2 is placed onto pronged drum 30 whereby the two circular arrays of drum prongs 34 (at regular-intervals T2) removably extend through carrier perforations 76 and are adapted to longitudinally feed carrier P2 as pronged drum 30 rotates counterclockwise about drum-axis 30A. As previously explained, when apparatus 10 is at intermittent "at rest" conditions, valve position 61A is "on", and the FIGS. 5-6 solid lines conditions for crank 33 and leadward block 59(having "N") are established. The, with valve position 61B instead being turned "on", compressed air causes driving-piston 38 and piston 58 to retract toward their respective casings 36 and 56 as indicated in FIGS. 5-6 phantom lines. Accordingly, driving-piston 38 (through crank 33) causes drum 30 to rotate counterclockwise for an angular-value cycle of 60° about drum-axis 30A. During this 60° rotation, two of the 30°-apart drum prongs 34 also arcuately pass by indexing-station "MN" and a camming first-component "M" attains said indexing-station. This results in a carrier longitudinal feed of an approximate-length roughly equivalent to the exact finite-length feed "FL2" desired. At the conclusion of the aforementioned step, the valve (61) program (e.g. valve position 61A now "on") permits compressed air to flow exclusively to casing ports 36C and 56C whereupon:

(i) driving-piston 38 (having crank pivotal connector 39) is extended away from casing 36 ready to actuate the next intermittent drum rotation. During this extension of driving-piston 38, sprag clutch 32 allows FIG. 6 clockwise rotation of drum shaft 31 while drum 30 remains motionless; and (ii) piston 58 including its V-indented("N") leadward block 59 is extended away from casing 56 to attain indexing-station "MN" whereat the camming second-component ("N") co-actably slidably moves against camming first-component ("M"). As this camming occurs between components "M" and "N", the previously attained approximate-length feed is rectified into the desired precise finite-length feed ("FL2") for carrier P2.

Because repeated camming operations between the V-indented block (59) and the drum pins("M") tend to rapidly wear such blocks (59) if fabricated of metallic structural material, such blocks are preferably fabricated from hard resinous materials. An especially apt such fabrication material is ultra-high molecular weight polyethylene.

Such camming operations between the piston carried V-indented block (59) and the drum pins ("M") are apt to occur so forcefully that inimical bending or twisting of such piston (58) tends to occur. However, the framework supporting means (20) might include the capability of preventing such bending or the capability of preventing such twisting. In this regard, a supporting means (20) might comprise a vertical support-plate 21 attached near its upper end 22 to framework 11 (e.g. at 25, 26) and having a centrally open boss 24 slidably surrounding piston 58 above leadward block 59 and thereby tending to prevent piston bending. Moreover, leadward block 59 might be slidably engaged along support-plate 21 and thereby tending to prevent piston twisting.

At initial startup for the precise intermittent feeding operation, it is necessary that the camming first-component (e.g. a pin "M") be located in close proximity to the extended piston(58,59,"N"). In order to correctly establish such apparatus indexing-station, the framework supporting means for the piston is desireably adjustably positionable along an arc having the drum-axis as the arc focal-point. In this vein, such arc might take the form of an arcuate slot 19 through framework 11 above drum-axis 30A. Lower portion 23 of support-plate 21 slidably surrounds drum shaft 31. Disposed on opposite sides of framework arcuate slot 19 are washer-plate 25 and support-plate 21, and mechanical fastener 26 passing through members 21 and 25 provide the desired arcuate adjustability for plunger 55 (including piston 58) about drum-axis 30A.

From the foregoing, the construction and operation of the precise intermittent feeding apparatus will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

I claim:

1. For indefinitely longitudinally lengthy carrier sheet material having a pair of substantially parallel longitudinally extending edges including a first-edge transversely spaced away from a second-edge thereof, said carrier along at least one of the two longitudinal edges thereof being provided with perforations spaced at regular-intervals, said perforations being of substantially identical shape and each having a prescribed finite-area, said carrier being provided with carried-members incrementally spaced at finite-lengths along the carrier longitudinal length, apparatus for accurately intermittently feeding the carrier at regular longitudinally extending exact finite-lengths, and said apparatus comprising:

(A) a framework including supporting means for supporting plunger means having a linearly reciprocatable piston terminating at a leadward-end;

(B) a cylindrically surfaced drum rotatable about a transversely extending drum-axis intersecting said framework, said drum cylindrical surface concentrically surrounding said drum-axis and having a finite-circumference, a plurality of prongs respectively extending radially outwardly from the drum cylindrical surface and said prongs being in a uniplanar circular array spaced at regular-intervals and whereby the finite-circumference is an exact multiple of said regular-intervals, and said prongs being of substantially identical cross-sectional shape and having a cross-sectional size of substantially said finite-area, at least one of said circumferentially spaced prongs being engageable through a like number of carrier edgewise perforations as said drum is being rotated;

(C) camming means of the two components pin-and-block type, a first-component of the camming means being distributed in a uniplanar circular array spaced at regular-spacings on said drum and at a substantially uniform finite-radius about the drum-axis;

(D) intermittent driving means for intermittently rotating the drum including its circularly arrayed prongs and camming means first-component at prescribed angular-value cycles whereby each driving cycle feeds the prong engaged carrier sheet material for a longitudinal approximate-length roughly equivalent to the desired exact finite-length; and (E) plunger means mounted to said framework supporting means and including a linearly reciprocatable piston, a second-component of the camming means being provided at the piston leadward-end, said camming means second-component being co-actably slidably moveable relatively against said drum mounted first-component and there defining an apparatus indexing-station whereby, at the conclusion of each angular-value cycle, the camming means second-component is co-actably moveable against the camming means first-component and rectify the previously attained approximate-length carrier feed into the exact finite-length feed desired for the carrier sheet material.

2. The apparatus of claim 1 wherein the camming means first-component comprises circularly arrayed pins respectively extending radially outwardly from the drum cylindrical surface, the radial extent for said pins exceeding the radial extent for said prongs, and the camming means second-component comprises a substantially V-shaped cross-sectionally indented leadward block for the reciprocatable piston.

3. The apparatus of claim 2 wherein the drum includes two transversely separated uniplanar circular arrays of radially extending prongs, respective prongs of each array being in transversely extending relationship with those of the other array; and wherein the regular-spacing for the camming pins to the drum prongs regular-intervals represents a ratio bearing an exact multiple of said regular-intervals.

4. The apparatus of claim 3 wherein the prescribed angular-value cycle for intermittently rotating the pronged drum causes at least two prongs from a single circular array to arcuately pass by said indexing-station.

5. The apparatus of claim 4 wherein the drum finite-circumference to the drum prongs regular-intervals represents an integral number ratio of at least four in number.

6. The apparatus of claim 5 wherein the pronged drum comprises a horizontal central shaft revolvably secured to said framework, and said drum shaft remote of its revolvable connection to said framework is provided with a multi-teeth sprocket.

7. The apparatus of claim 3 wherein the cross-sectionally V-shaped indented leadward block is provided of a hard resinous material.

8. The apparatus of claim 7 wherein the hard resinous material comprises ultra-high milecular weight polyethylene.

9. The apparatus of claim 8 wherein the prescribed angular-value cycle for intermittently rotating the pronged drum causes at least two drum prongs to arcuately pass by said apparatus indexing-station; wherein the framework supporting means for the plunger means includes a steadying means for the linearly reciprocatable piston and the camming second-component thereat; wherein the plunger means extends generally vertically alongside the framework supporting means therefor, said supporting means being adjustably positionable along an arc having the drum-axis as the arc focal-point; and wherein the framework supporting means for the plunger means includes a steadying means, said steadying means having the dual capability of preventing bending of said linearly reciprocatable piston and of preventing twisting of said indented leadward block.

10. The apparatus of claim 9 wherein there is a vertical support-plate attached to the framework and slidably surrounding the horizontal shaft of the pronged drum, the plunger casing being substantially vertically alongside and being attached to said support-plate, said support-plate including a tubular boss surrounding the plunger piston above the indented leadward block, and said indented leadward block being vertically slidably disposed along said support-plate; and wherein the indented leadward block is provided of a hard resinous material.

11. The apparatus of claim 10 wherein the intermittent driving means for the pronged drum comprises a horizontal drum shaft rotatably secured to the framework, a crank extending radially outwardly from the drum central shaft, a linearly extending driving-piston pivotably connected to said crank, and a sprag clutch located exteriorally of the drum central shaft for limiting the pronged drum to a single direction angular movement about the drum central shaft and drum-axis.

12. The apparatus of claim 11 wherein the framework supporting means for the plunger means includes a steadying means for the linearly reciprocatable piston and the camming second-component thereat.

13. The apparatus of claim 12 wherein said steadying means includes the capability of preventing bending of said linearly reciprocatable piston as its camming second-component attains the apparatus indexing-station.

14. The apparatus of claim 13 wherein said steadying means includes the capability of preventing twisting of said piston carried camming second-component as said second-component attains the apparatus indexing-station.

15. The apparatus of claim 14 wherein said steadying means also includes the capability of preventing bending of said linearly reciprocatable piston as its camming second-component attains the apparatus indexing-station.

16. The apparatus of claim 15 wherein said dual capability steadying means comprises for the framework supporting means a vertical support-plate attached to the framework whereby the plunger casing might be mounted substantially vertically alongside said support-plate, said support-plate including a tubular boss surrounding the plunger piston above the camming second-component, and said camming second-component being vertically slidably disposed along said support-plate.

17. The apparatus of claim 16 wherein the plunger means extends generally vertically alongside the framework supporting means therefor, said supporting means being adjustably positionable along an arc having the drum-axis as the arc focal-point.

* * * * *